US007710256B2

(12) United States Patent
Tawil

(10) Patent No.: US 7,710,256 B2
(45) Date of Patent: May 4, 2010

(54) METHOD AND APPARATUS FOR AUDIO ASSISTED TESTING

(75) Inventor: Fady S. Tawil, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 329 days.

(21) Appl. No.: 11/361,194

(22) Filed: Feb. 23, 2006

(65) Prior Publication Data

US 2007/0194907 A1 Aug. 23, 2007

(51) Int. Cl.
*G08B 29/00* (2006.01)

(52) U.S. Cl. ..... 340/514; 340/506; 340/3.1; 340/825.36; 340/825.49; 340/539.1; 340/539.11; 340/539.24

(58) Field of Classification Search ..... 340/514, 340/506, 3.1, 825.36, 825.49, 539.1, 539.11, 340/539.24
See application file for complete search history.

(56) References Cited

U.S. PATENT DOCUMENTS

| | | | | |
|---|---|---|---|---|
| 5,905,438 | A * | 5/1999 | Weiss et al. | 340/636.1 |
| 5,959,529 | A * | 9/1999 | Kail, IV | 340/539.12 |
| 6,608,559 | B1 * | 8/2003 | Lemelson et al. | 340/539.13 |
| 6,727,810 | B1 * | 4/2004 | Martin et al. | 340/506 |
| 6,737,967 | B2 * | 5/2004 | Farley | 340/514 |
| 6,838,988 | B2 * | 1/2005 | Lennartz et al. | 340/539.26 |
| 6,950,016 | B2 * | 9/2005 | Farley | 340/514 |
| 7,148,803 | B2 * | 12/2006 | Bandy et al. | 340/539.16 |
| 7,167,088 | B2 * | 1/2007 | Farley | 340/514 |

* cited by examiner

*Primary Examiner*—Daryl Pope
(74) *Attorney, Agent, or Firm*—Husch Blackwell Sanders Welsh & Katz

(57) ABSTRACT

A cell phone based test capability enables a tester to audibly communicate with a fire alarm control unit. A detector can be selected and tested. Test results can be audibly communicated to the tester via the cell phone. The tester can initiate the next test via the cell phone.

23 Claims, 3 Drawing Sheets

METHOD AND APPARATUS FOR AUDIO ASSISTED TESTING

FIELD OF THE INVENTION

The invention pertains to fire alarm systems. More particularly, the invention pertains to such systems which incorporate cost effective test facilities.

BACKGROUND

It has been recognized that there are benefits to incorporating various types of monitoring systems in residential and commercial regions. Some of these types of monitoring systems include HVAC-type systems, intrusion monitoring systems (burglar alarm systems) as well as fire alarm and gas detection systems. Fire alarm and gas detection systems are often subject to mandatory testing on a regular basis. Some of these tests are conducted during an initial installation, expansion or modification of the system. Others are required on a periodic basis.

Where the fire alarm system incorporates smoke detectors which might be distributed throughout a region being monitored one form of testing is to sequentially direct smoke at each of the detectors. The respective detector, if functioning properly, can be expected to exhibit an alarm condition which can be sensed at a fire alarm control panel. The fire alarm control panel in response can then display or announce the presence of the detected alarm condition to a local operator.

The above process historically has required two individuals. One at the control panel. The other carries out a walk test and provides a smoke sample for each of the detectors. The individual at the fire alarm control panel can then reset the system and the individual conducting the test can be instructed via a wireless device such as a walkie-talkie or cell phone to move to the next detector to be tested. Confirmatory information can be provided to the individual conducting the walk test as to which of the detectors the system has been tested.

The above-described process requires two individuals, one at the control panel and one to conduct the walk test. In view of the expense associated with the needing to dedicate two individuals to carry out the testing process it would be desirable to be able to automate at least some of the functions that need to be carried out at the control panel in order to implement the testing process. Preferably the control panel could interact with that individual substantially in the same way as the operator has historically interacted with the individual conducting the walk test.

It would also be preferable to use the equipment presently available to such control panels to implement a one person test function. Further it would also be desirable to automatically maintain a real time log of the ongoing test process for audit purposes.

DETAILED DESCRIPTION

Figure 1:
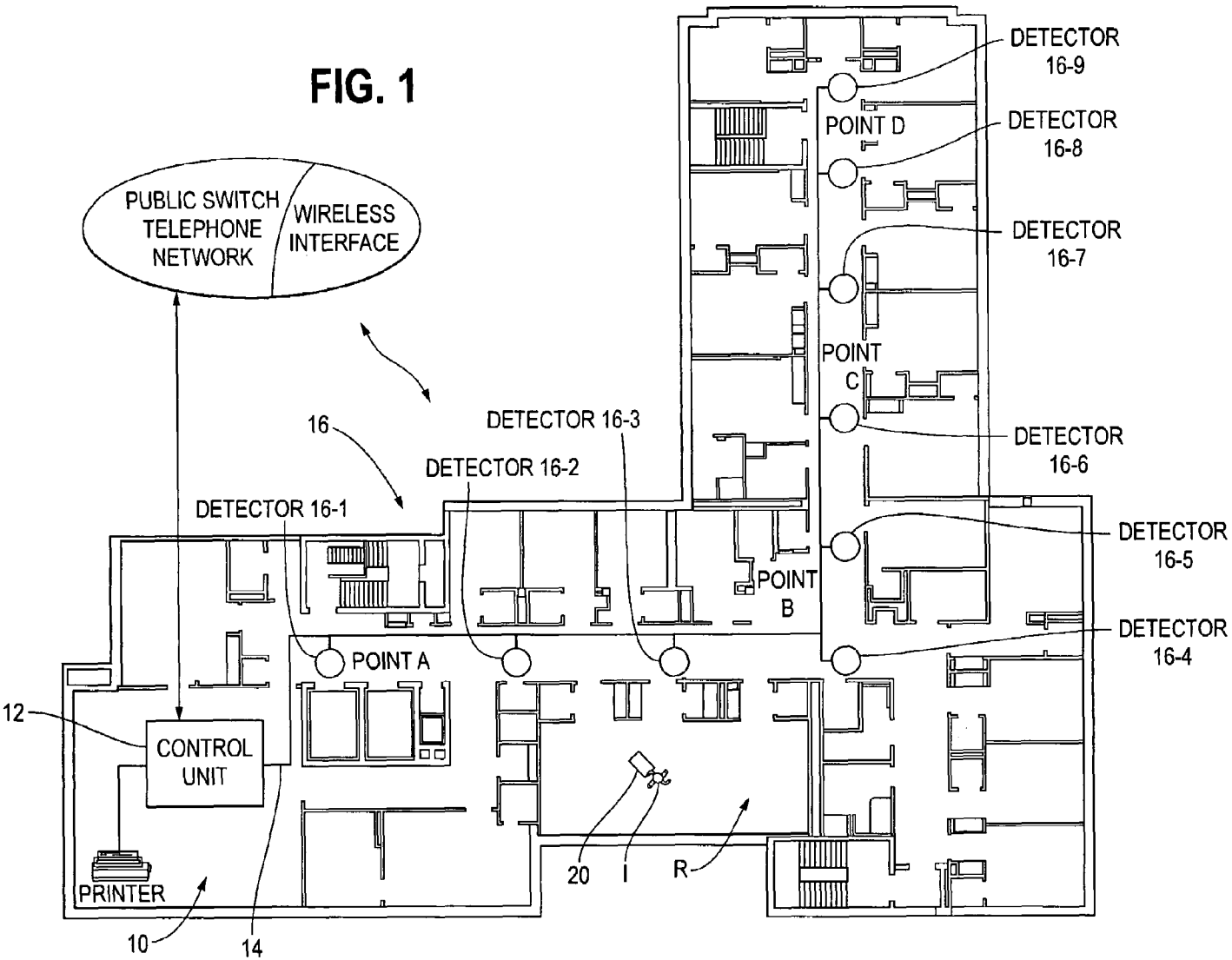
FIG. 1 is a top plan view of a region with a monitoring system in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments on the invention eliminate a need for an individual to be present at a control unit of an ambient condition monitoring system, such as a fire alarm system, while another person is out in the region being monitored testing of various of the detectors. In a disclosed embodiment, a wireless communication device, such as a cell phone, can automatically send and receive either verbal or text messages between the control unit and the individual testing the detectors in the region being monitored.

The control unit in one aspect of the invention can prompt the test individual to enter a number for the respective phone, such that the phone can be accessed via the switched telephone network prior to activating an audio walk test mode. The wireless device or cell phone can then be used to generate commands off the keypad or to generate a verbal commands to the control unit or to receive voice prompts or text messages therefrom. During the test sequence for a given detector, when an alarm has been detected the control unit can communicate the detected condition as well as an identification of the location and/or detector via either text messaging or voice prompts. The tester can then enter a command either via a keypad or verbally to reset the test condition and then move on to the next detector.

In a disclosed embodiment of the invention, the control unit of a fire alarm system can include control software as well as a DTMF-type interface for communication via the switched telephone network with a cellular telephone. The control unit can incorporate speech recognition programs and circuitry to receive verbal commands as well as text messages from the cellular telephone. Additionally, the control unit can incorporate speech synthesizing circuitry to provide verbal prompts to the individual conducting the tests in the region being monitored and can also send text messages to that individual.

Figure 2:
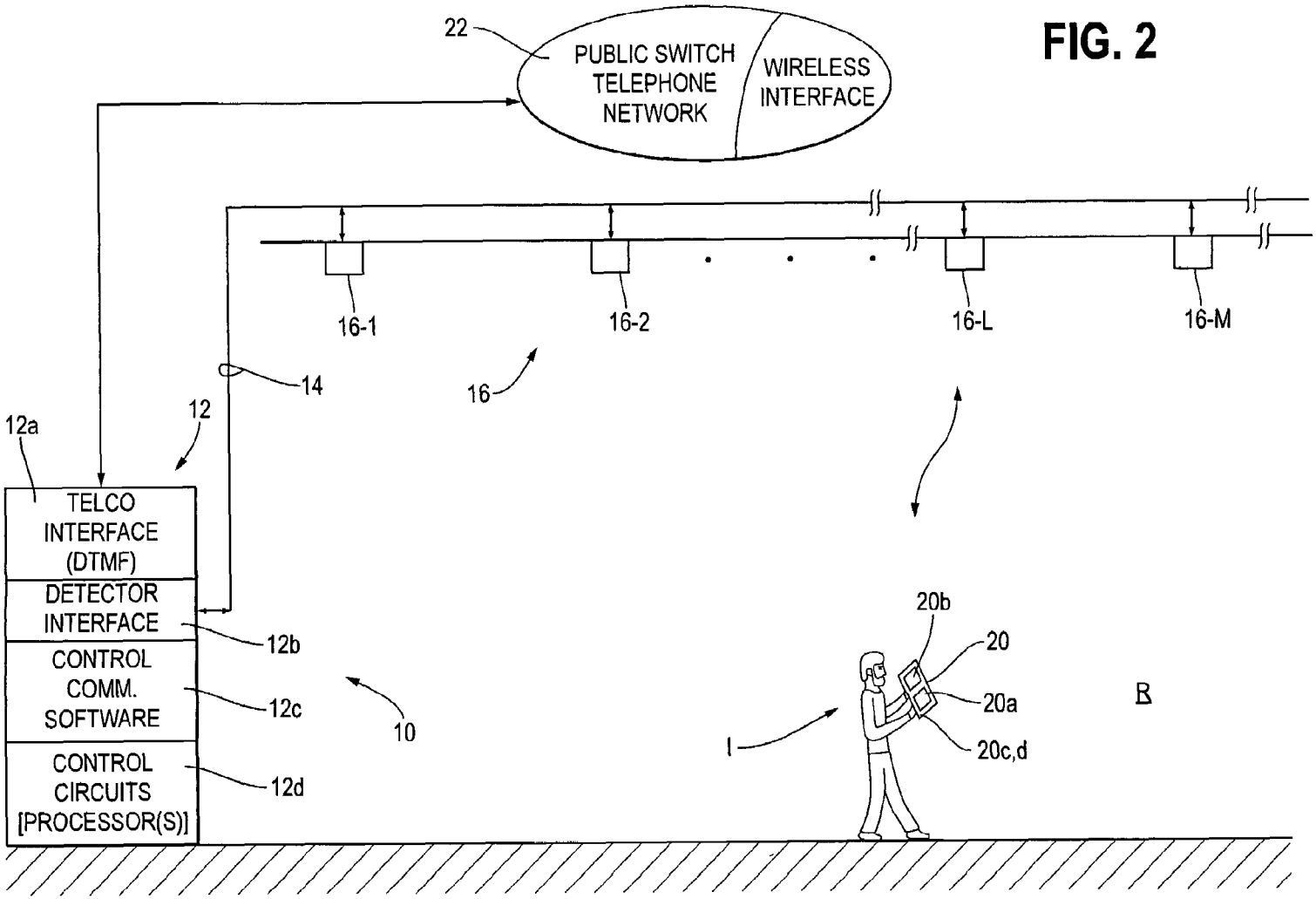
FIG. 2 is a side elevational view of a portion of the region of FIG. 1.

FIG. 1 is a top plan view which illustrates a region R being monitored by a ambient condition detection system, such as a fire alarm system 10 in accordance with the invention. FIG. 2 is a partial side elevational view of the region R and system 10.

It will be understood that the exact nature of the system 10 is not a limitation of the present invention. System 10 could encompass alternately HVAC-type systems, intrusion detection systems and the like all without limitation.

System 10 incorporates a control unit 12 which communicates via medium 14 to a plurality 16 of detectors installed throughout the region R. As can be seen in the figures the detectors are installed so as to be fixedly mounted and stationary. The detectors 16 can include smoke detectors, flame detectors, heat detectors, humidity detectors, intrusion detectors and the like all without limitation. It will be understood that the medium 14 could be either wired or wireless in-part or wholly all without limiting the present invention.

In accordance with the invention an individual I can conduct a walk test relative to each of the members of the plurality 16, 16-1, -2 . . . -n. While conducting this test process the individual I, as shown in FIG. 2, in the visual and/or audio vicinity of the detectors to be tested, can utilize a wireless communication device 20, such as a wireless telephone for purposes of communicating, via the public switched telephone network 22 with the control unit 12. It will be understood that the type of wireless service provided as well as the exact characteristics of the wireless communication device 20 are not limitations of the present invention. Preferably the device 20 will include a keypad 20*a*, a display 20*b* as well as audio input and output transducers 20*c, d* as is conventional with such devices.

In one embodiment of the invention the individual I can initiate communications with the control unit 12 via the telephone network 22, using wireless device 20, for purposes of directing the control unit 12 to enter a predetermined walk test mode. Commands can be communicated via the device 20 either verbally, to be recognized by speech recognition circuitry and programs of the unit 12 or via the keypad 20*a* also for recognition by the control unit 12.

The individual I can select a particular detector, such as detector 16-1 and present to that detector an appropriate physical stimuli. For example, for smoke detectors the individual I could spray a smoke substitute at the respective detector to establish a test condition. Alternately, a heating element can be used to blow hot air at a thermal detector.

The control unit 12 in response to signals received from the respective detectors such as 16-*i* via media 14 can verbally or via text messaging communicate with the individual I using the switched telephone network 22 and the wireless unit 20. In addition, the control unit 12 can enter an alarm state causing one or more system audible output devices such as horns, sirens, strobe lights or the like to emit an output indicative of the state of the respective detector 16-*i*. The individual I can then issue a follow-up command via wireless device 20 to the control unit 12 terminating the test state so that the next detector in the region R can be tested.

The control unit 12 can incorporate a variety of hardware and software to implement the processing of the present invention, best seen in FIG. 2. Control unit 12 can incorporate a telephone DTMF-type interface 12*a*, a detector interface 12*b* which can be in bi-directional communication with the detectors 16-*i* via medium 14. The invention also contemplates the interface 12*b* may only receive signals from the respective detectors such as 16-*i* and does not necessarily communicate on a bi-directional basis with those detectors. The medium 14 could be wired or wireless or both.

Unit 12 can also include control and communication software 12*c* for carrying out the various functions including analysis of signals received from the members of the plurality detectors 16 as well as from the wireless unit 20, generating or producing either verbal or textual feedback coupled via the switched telephone network 22 to the wireless device 20. Control unit 12 also includes control circuits 12*d* which might include one or more processors for execution of the software 12*c* for implementing the above described functions.

Figure 3:
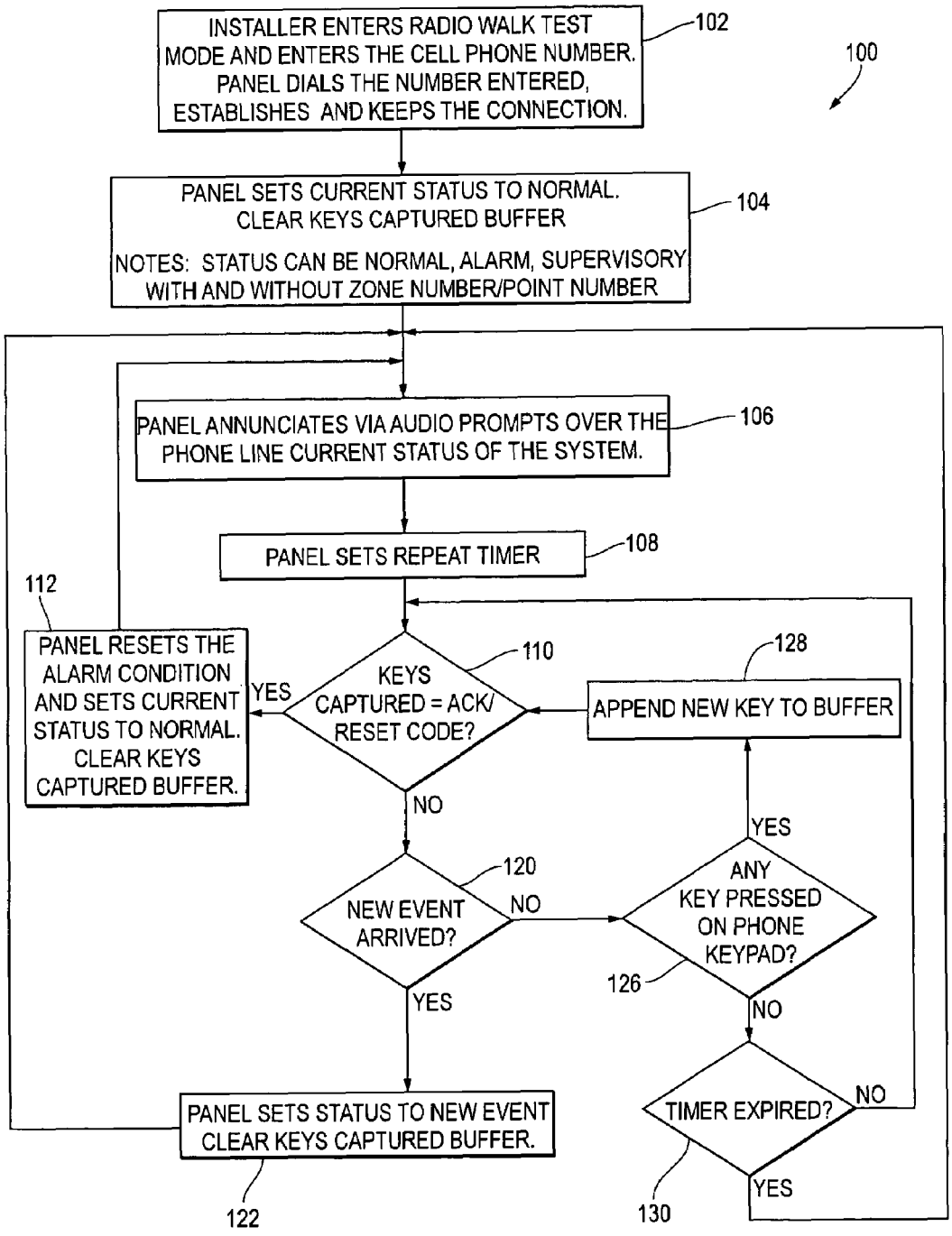
FIG. 3 is a flow diagram illustrating aspects of a method in accordance with the invention.

FIG. 3 illustrates a process 100 which implements various aspects of the present invention. In a step 102 tester or installer I causes the control unit 12 to enter an audio walk test mode and also enters the identification of telephone number of unit 20. The control unit 12 can dial the wireless unit 20 via the switched telephone network 22. Control unit 12 can also maintain the connection on an on-going basis.

In a step 104 the control unit 12 can establish a current status as normal and can clear keys captured buffer. In a step 106 the control unit 12 can provide audible or text based prompts concerning the current status of system 10 via the switched telephone network 22 and the unit 20.

In a step 108 the control unit 12 can establish a time duration with a repeating timer. In a step 110 various received keys are analyzed by the software 12*c* at the unit 12 to determine the nature and the requirements of the command or commands. Where an ACK, acknowledge or, reset code has been received in a step 112 the control unit 12 can reset an existing alarm condition and return the current status of the system 10 to normal or a non-alarm state.

In a step 120 where a new event has arrived from one of the detectors, such as 16*i*, indicative of an alarm condition (created for example by the individual 1), the control unit 12 can set the system's status to that indicated by the new event, step 122. Unit 12 can also annunciate the source of the alarm, the detector 16*i*, to the individual I via the telephone network 22 and wireless unit 20. In addition, the respective detector can emit an alarm indicator if locally available. If desired, other alarm indicators can be activated. Where an incomplete command has been received, in a step 126 the system 12 can sense the presence of any key depression at the unit 20.

Alternately, in step 126 a received verbal message could be analyzed by software 12*c* as an alternate to received key signals. Newly received key signals can be added to the buffer, step 128.

In the event that the timer has expired step 130 the control unit 12 can re-enter step 106 for further processing.

It is will be understood that the processing of method 100 of FIG. 3 is exemplary only. Variations therein come within the spirit and scope of the invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A method testing of permanently mounted stationary sensors of an alarm system comprising:

establishing a wireless communication path between an alarm system control unit and a portable wireless communications device in the audio and/or visual vicinity of one of the stationary detectors associated with the alarm system, the control unit is in a first state;

sending a command from the wireless communication device to the control unit to exit the first state and to enter a walk test mode;

identifying a stationary detector to be tested using the communication path, at the control unit, the control unit responding to a test signal from the detector by entering a predetermined state; and sending a command from the wireless communications device to the control unit to exit from the predetermined state and to enter a normal or a non-alarm state.

2. A method as in claim 1 which includes forwarding a command, via the communication path, to the control unit to return to the first state.

3. A method as in claim 1 which includes establishing a test condition in the vicinity of the detector to be tested and responsive thereto generating the test signal.

4. A method as in claim 3 where fire alarm systems are being tested and establishing includes establishing an airborne test condition selected from smoke substitutes and/or hot air and the portable wireless communication device is a cell phone.

5. A method as in claim 3 where establishing includes placing the detector to be tested into a test state.

6. A method as in claim 3 which includes forwarding a command, via the communication path, to the control unit to return to the first state.

7. A method as in claim 1 which includes coupling audio indicia relative to the test signal via the communication path to the communications device.

8. A method as in claim 7 which includes forwarding a command, via the communication path, to the control unit to return to the first state.

9. A method as in claim 8 where forwarding the command includes forwarding a spoken command or a keyed command.

10. A method as in claim 9 which includes establishing a file of test results.

11. An apparatus comprising:

a system which monitors ambient conditions in a region, the system including a plurality of permanently mounted stationary ambient condition detectors and an interface for receiving communications from a portable wireless source of commands;

the portable wireless source of commands operable in the audio and/or visual vicinity of one of the stationary detectors to be tested, the source having at least one of a manually operable command input port, or an audio input transducer with the system responsive to a command received from the source to enter a walk test mode, to further respond to signals from a selected detector and, to emit at least an audible alarm with the system additionally responding to a command from the source to terminate the audible alarm and test state of the selected detector to allow testing of other detectors and with the system additionally responding to signals from the source to return the status into a normal or non-alarm state.

12. An apparatus as in claim 11 where the portable source comprises a wireless telephone.

13. An apparatus as in claim 12 where the wireless telephone communicates with the system interface via a public switched telephone network.

14. An apparatus as in claim 13 where the system includes speech recognition circuitry.

15. An apparatus as in claim 14 which includes circuitry and software responsive to received audible commands to select the detector.

16. An apparatus as in claim 15 which includes circuitry and software responsive to received audible commands to terminate the alarm state of the selected detector.

17. An apparatus as in claim 15 where the audible commands are at least one of tones or speech.

18. An apparatus as in claim 17 where the system interface outputs verbal information to the portable source.

19. An apparatus as in claim 18 where the system interface includes software for compiling a log of tested detectors.

20. An apparatus as in claim 19 where the detectors are selected from a class which includes at least smoke detectors, thermal detectors, motion detectors, flame detectors, gas detectors and humidity detectors and the detectors are wired to a control unit, a wireless communication path between the control unit and the wireless telephone.

21. An apparatus as in claim 11 where the system interface includes circuitry to output audio, via the source, related to the alarm state.

22. An apparatus as in claim 11 where the system interface includes circuitry to output at least one of verbal or text messages to the source.

23. An apparatus as in claim 22 where the system interface includes circuitry to receive at least one of verbal or text messages from the source.

* * * * *